US011326754B2

(12) United States Patent
Erdl et al.

(10) Patent No.: US 11,326,754 B2
(45) Date of Patent: May 10, 2022

(54) ILLUMINATION APPARATUS FOR A MOTOR VEHICLE

(71) Applicant: Bayerische Motoren Werke Aktiengesellschaft, Munich (DE)

(72) Inventors: Helmut Erdl, Flintsbach (DE); Abdelmalek Hanafi, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 17/427,239

(22) PCT Filed: Jan. 28, 2020

(86) PCT No.: PCT/EP2020/052034
§ 371 (c)(1),
(2) Date: Jul. 30, 2021

(87) PCT Pub. No.: WO2020/157060
PCT Pub. Date: Aug. 6, 2020

(65) Prior Publication Data

US 2022/0099262 A1 Mar. 31, 2022

(30) Foreign Application Priority Data

Jan. 31, 2019 (DE) ..... 10 2019 102 460.9

(51) Int. Cl.
*F21S 41/176* (2018.01)
*F21S 41/365* (2018.01)
(Continued)

(52) U.S. Cl.
CPC ..... *F21S 41/176* (2018.01); *F21S 41/16* (2018.01); *F21S 41/33* (2018.01); *F21S 41/365* (2018.01); *F21S 43/10* (2018.01); *F21Y 2115/30* (2016.08)

(58) Field of Classification Search
CPC .. F21S 41/16; F21S 41/176; F21S 41/33–365; F21S 43/10; F21S 43/16; F21Y 2115/30
See application file for complete search history.

(56) References Cited

U.S. PATENT DOCUMENTS 9,550,939 B2 1/2017 Yoshimatsu
9,574,733 B2 * 2/2017 Kushimoto ..... F21V 9/30
(Continued)

FOREIGN PATENT DOCUMENTS

DE 10 2009 024 941 A1 12/2010
DE 10 2012 209 172 A1 12/2013
(Continued)

OTHER PUBLICATIONS

International Search Report (PCT/ISA/210) issued in PCT Application No. PCT/EP2020/052034 dated May 26, 2020 with English translation (five (5) pages).
(Continued)

*Primary Examiner* — Jason M Han
(74) *Attorney, Agent, or Firm* — Crowell & Moring LLP

(57) ABSTRACT

An illumination apparatus for a motor vehicle includes a light source for emitting light of a first mixed color, said light source containing one or more laser diodes for generating monochromatic light and a first conversion element for converting the monochromatic light into the light of the first mixed color. The illumination apparatus also includes a first optical device which images the light source as a real image in an intermediate image plane, and a second optical device which generates a predefined light distribution from the real image in the intermediate image plane. A second conversion element is provided at the site of the real image in the intermediate image plane in order to convert the light of the first mixed color into light of a second mixed color.

16 Claims, 3 Drawing Sheets

(51) Int. Cl.

| | |
|---|---|
| ***F21S 41/33*** | (2018.01) |
| ***F21S 43/10*** | (2018.01) |
| ***F21S 41/16*** | (2018.01) |
| ***F21Y 115/30*** | (2016.01) |

(56) References Cited

U.S. PATENT DOCUMENTS

| | | | |
|---|---|---|---|
| 2007/0189352 | A1 | 8/2007 | Nagahama et al. |
| 2012/0176769 | A1 | 7/2012 | Reimer et al. |
| 2015/0124428 | A1 | 5/2015 | Hadrath et al. |
| 2015/0285457 | A1 | 10/2015 | Erdl et al. |
| 2015/0308636 | A1 | 10/2015 | Daniels |
| 2016/0146434 | A1 | 5/2016 | Moench et al. |
| 2017/0108190 | A1 | 4/2017 | Hadrath |

FOREIGN PATENT DOCUMENTS

| | | | |
|---|---|---|---|
| DE | 10 2012 223 610 | A1 | 6/2014 |
| DE | 10 2013 107 227 | A1 | 1/2015 |
| DE | 10 2014 202 863 | A1 | 8/2015 |
| DE | 10 2014 207 664 | A1 | 10/2015 |
| JP | 2009-266437 | A | 11/2009 |
| WO | WO 2013/018449 | A1 | 2/2013 |

OTHER PUBLICATIONS

German-language Written Opinion (PCT/ISA/237) issued in PCT Application No. PCT/EP2020/052034 dated May 26, 2020 (four (4) pages).

German-language Search Report issued in German Application No. 10 2019 102 460.9 dated Oct. 8, 2019 with partial English translation (13 pages).

* cited by examiner

ILLUMINATION APPARATUS FOR A MOTOR VEHICLE

BACKGROUND AND SUMMARY OF THE INVENTION

The invention relates to an illumination apparatus for a motor vehicle and a corresponding motor vehicle.

Using so-called converting elements, which convert the monochromatic light of a light source into another wavelength range, for example to generate white light, is known from the related art in motor vehicle illumination apparatuses.

The problem exists in the use of converting elements in motor vehicle illumination apparatuses based on laser light that due to the high output of the laser light, strong heating of the converting material occurs, which reduces the efficiency of the light conversion and under certain circumstances has the result that stable color conversion is no longer ensured.

The object of the invention is to provide an illumination apparatus based on laser light for a motor vehicle having efficient and stable light conversion.

This object is achieved by the claimed invention.

The illumination apparatus according to embodiments of the invention is provided for a motor vehicle, for example a passenger vehicle, a truck, and possibly also a motorcycle. The illumination apparatus comprises a light source for emitting light of a first mixed color, wherein the light source contains one or more laser diodes for generating monochromatic light and a first converting element for converting the monochromatic light into the light of the first mixed color. The light source is therefore based on laser light, the wavelength of which is converted via a suitable first converting element into a first mixed color. The light of the light source is the light radiation originating from the first converting element in the first mixed color. Here and hereinafter, the light of the first mixed color and also the light of the second mixed color, which is defined below, are to be understood as light radiation in a wavelength range which is visible to the human eye. In contrast thereto, the monochromatic light of the laser diode or the laser diodes can be in the visible and possibly also in the nonvisible wavelength spectrum.

The illumination apparatus according to embodiments of the invention furthermore contains a first optical device which images the light source as a real image in an intermediate image plane. In other words, the first optical device effectuates optical imaging which generates a real image of the light source in a corresponding intermediate image plane. The illumination apparatus furthermore comprises a second optical device, which generates a predetermined light distribution from the real image in the intermediate image plane.

The illumination apparatus according to embodiments of the invention is distinguished in that a second converting element is provided at the location of the real image in the intermediate image plane in order to convert the light of the first mixed color into light of a second mixed color. In other words, the second converting element is positioned spatially separated from the first converting element in the intermediate image plane and is thermally decoupled from the first converting element. In this way, the heat development which is induced by the light originating from the light source is distributed onto two converting elements, which, at equal incident light output, results in lower temperatures in the respective converting elements in comparison to the use of a single converting element and thus in efficient and stable light converting.

In one particularly preferred embodiment, the light source based on laser light is an essentially punctiform light source. The maximum dimension of the punctiform light source in a top view, i.e., seen in the main beam direction having the greatest intensity of the light source, is in one particularly preferred embodiment 500 μm or less, preferably 100 μm or less, and particularly preferably 20 μm or less. Furthermore, the punctiform light source preferably has an emitting area in a top view of 0.5 $mm^2$ or less, in particular 0.01 $mm^2$ or less, and particularly preferably 0.0002 $mm^2$ or less. The punctiform light source in particular comprises an emitting polygonal area, the edges of which have a length of 500 μm or less and preferably of 20 μm or less. The punctiform light source having the dimensions just described is preferably designed in such a way that it generates a luminous flux of 100 Lm or more and in particular 200 Lm or more and/or has a radiant output of 1 Watt or more and/or a light density of at least $3\times10^8$ $Cd/m^2$ and in particular of $10^9$ $Cd/m^2$ or more. Such punctiform light sources can only be achieved using laser light employing laser diodes.

In a further preferred embodiment, the laser diode or laser diodes are configured for generating blue light (wavelength range 420 nm to 490 nm) and/or violet light (wavelength range 380 nm to 420 nm) and/or UV light (wavelength range 200 nm to 380 nm). In contrast, the first mixed color is preferably a white light color. This white light color is in the so-called ECE white light range in one particularly preferred embodiment. This white light range is defined in the so-called ECE regulations relating to assuming uniform technical guidelines for motor vehicles in regulation number 48 (https://www.unece.org/fileadmin/DAM/trans/main/wp29/wp29regs/2013/R048r9e.pdf). The ECE white light range is defined by corners of a polygon in the CIE chromaticity diagram. The polygon encloses the ECE white light range and therefore represents its border. The corresponding coordinates of the corner points of the polygon are explicitly specified in the detailed description.

In a further preferred embodiment, the second mixed color which is generated by the second converting element is also a white light color, which is preferably also in the ECE white light range. In this way, a white light mixed color typical for motor vehicle illumination apparatuses is generated.

In a further preferred embodiment, the second converting element is designed in such a way that the first mixed color is shifted toward the second mixed color in the ECE white light range. The finding is made use of here that known (first) converting elements often generate a mixed color which does not lie in or lies at the border of the ECE white light range. By using a suitable second converting element, a preferred mixed color in the interior of the white light range can be set.

In a further, particularly preferred embodiment, the second converting element is designed in such a way that to generate the second mixed color, it reduces light output in a blue spectral component of the first mixed color and increases light output in a red spectral component of the first mixed color.

First and second converting elements having the above-described properties for generating a first or second mixed color, respectively, as a white light color or for reducing the light output in the blue spectral component and increasing the light output in the red spectral component are routine to a person skilled in the art. In particular, such converting elements can be used which are described in documents U.S. Pat. No. 9,550,939 B2 and US 2007/0189352 A1. The entire content of the disclosure of these documents is made part of the content of the present application.

In one preferred embodiment, Ce:YAG phosphor or cerium-doped nitride phosphor or cerium-doped oxide-nitride phosphor is used as the first converting element, whereas preferably a so-called red phosphor is used as the second converting element, which reduces light output in a blue spectral component and increases light output in a red spectral component. The red phosphor is preferably a europium-doped substance.

In one preferred embodiment, one of the following materials is used as the first converting element:

Ce:YAG phosphor, cerium-doped nitride phosphor, cerium-doped oxide-nitride phosphor, $CaAlSiN_3:Eu^{2+}$, $Sr_2Si_5N_8Eu^{2+}$, $M_2SiO_4:Eu^{2+}$ where $M=Ba^{2+b}$, $Sr^{2+}$, $Ca^{2+}$, $Sr_{1-x}AlSi_4N_7:Eu_x$, where preferably x=0.03, $Li_3Ba_2La_3(MoO_4)_8$:(Eu3+,Tb3+), or $Y_2O_2S:EU^{3+}$.

One of the materials just mentioned is preferably also used for the second converting element, wherein the materials of the first and second converting element can differ from one another, however. Of the above-mentioned materials, the Ce:YAG phosphor is preferably combined with one or more blue laser diodes, whereas the cerium-doped nitride phosphor or the cerium-doped oxide-nitride phosphor is preferably combined with one or more violet laser diodes. In contrast, one or more laser diodes having blue and/or violet laser light are preferably used for the above-mentioned europium-doped substances with the exception of the last-mentioned substance, whereas the substance $Y_2O_2S:Eu^{3+}$ is preferably combined with one or more laser diodes which emit UV light.

In a further preferred embodiment of the illumination apparatus according to the invention, the first converting element and the second converting element are formed from the same base material, i.e., they have the same chemical composition (except for the dopant atoms). The dopant atoms are not associated here and hereinafter with the chemical composition due to their low concentration. However, the two converting elements preferably also contain the same type of dopant atoms, possibly also at the same concentration.

In an alternative embodiment of the illumination apparatus according to the invention, the first converting element and the second converting element are formed from different base materials, i.e., the converting elements have different chemical compositions. The dopant atoms or their concentration can be the same or also different for both converting elements.

Depending on the embodiment, the first converting element and/or the second converting element can be remissive or transmissive. A remissive converting element is distinguished in that the converted light radiation is emitted from the same side of the converting element on which the light radiation to be converted is incident. A transmissive converting element is distinguished in that the converted light radiation is emitted from the side of the converting element which is opposite to the side of the incident light radiation to be converted.

Depending on the embodiment, the first or second optical device can comprise different components. In particular, they can comprise one or more lenses and/or one or more reflectors, for example shape reflectors. The second optical device does not necessarily have to effectuate optical imaging. Rather, it is sufficient if a suitable beam deflection is effectuated by the second optical device. For example, the second optical device can consist solely of a diffuser plate.

The illumination apparatus according to embodiments of the invention can assume different functions in the motor vehicle. The illumination apparatus is preferably a headlight, in particular a front headlight, using which a white light distribution is generated. Nonetheless, the illumination apparatus can possibly also represent a signal light, for example a tail light.

The invention additionally relates to a motor vehicle which comprises one or more illumination apparatuses according to embodiments of the invention or one or more preferred variants of the illumination apparatus according to embodiments of the invention.

Exemplary embodiments of the invention are described in detail hereinafter on the basis of the appended figures.

DETAILED DESCRIPTION OF THE DRAWINGS

In the following, an embodiment of an illumination apparatus according to the invention is described on the basis of a front headlight which generates a white light distribution in the form of low beams or high beams in front of the motor vehicle by using a laser diode. Nonetheless, the invention is also applicable to other types of motor vehicle illumination apparatuses and in particular signal lights, which can possibly also emit colored light, for example red light.

Figure 1:
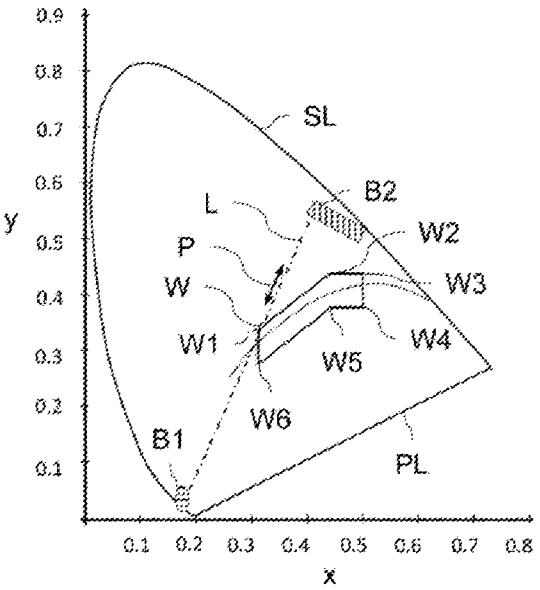
FIG. 1 shows the illustration of a color shift in the CIE chromaticity diagram to explain the stated problem solved by embodiments of the invention.

FIG. 1 shows the color space, which is known per se, of the CIE standard valence system, which is also referred to as the CIE chromaticity diagram. The color perception is described here by the two color coordinates x and y. The CIE chromaticity diagram contains the horseshoe-shaped spectral color line SL, along which the pure spectral colors extend. The spectral color line SL is bounded at the bottom by the so-called purple line PL. All mixed colors perceptible to the eye are delimited by the spectral color line SL and the purple line PL. Furthermore, a polygon having the corner points W1, W2, W3, W4, W5, and W6 is illustrated in FIG. 1. The area delimited by the polygon corresponds to the ECE white light range known as such, which defines suitable white light mixtures for illumination apparatuses in motor vehicles according to the so-called ECE regulations. Specifically, this white light range is defined in ECE regulation number 48 under section 2.29.1 (https://www.unece.org/fileadmin/DAM/trans/main/wp29/wp29regs/2013/R048r9e.pdf).

The values for the coordinates x and y of the corner points W1 to W6 are defined as follows in the corresponding ECE regulation:

| | x | y |
|---|---|---|
| W1 | 0.310 | 0.348 |
| W2 | 0.453 | 0.440 |
| W3 | 0.500 | 0.440 |
| W4 | 0.500 | 0.382 |
| W5 | 0.443 | 0.382 |
| W6 | 0.310 | 0.283 |

In a related art headlight based on laser light, the light of the headlight is generated, for example, using a laser light source, which converts blue light from one or more laser diodes by way of a converting element in the form of a cerium-doped YAG phosphor into white light. The wavelength range of the blue laser light is shown by the range B1 in FIG. 1. Color mixing is achieved by the phosphor in that a part of the blue light is converted into light having a spectral focal point in range B2. The range B2 represents a mixed color in the yellow color range. The color mixing can be varied via the variation of the layer thickness of the converting element or the change of the dopant concentration of the YAG phosphor with cerium, so that the mixed color can travel in the CIE chromaticity diagram linearly along the line L between the ranges B1 and B2, as indicated by the double arrow P. The goal is now to adjust the mixed color so that it is located as centrally as possible in the ECE white light range, since particularly suitable white light colors for headlights are located there.

Figure 2:
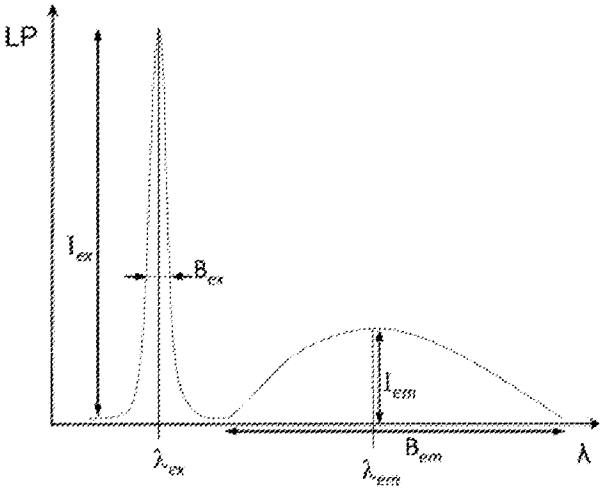
FIG. 2 shows the illustration of the spectrum at the white light point W of FIG. 1 in a related art illumination apparatus.

As is apparent from FIG. 1, the problem exists if cerium-doped YAG phosphor is used as the converting element that white light can be generated essentially only at the point W at the edge of the ECE white light range, since a color shift can only be achieved linearly according to the arrow P. The spectrum of the mixed color at the white light point W is shown in FIG. 2. The abscissa of this diagram corresponds to the wavelength $\lambda$ and the ordinate represents the light output LP as a function of the wavelengths of the spectrum. As can be seen, the spectrum of the white light point W contains a peak at the blue wavelength $\lambda_{ex}$. This peak has the width $B_{ex}$ and a height $I_{ex}$ and represents the blue color component according to the range B1 in FIG. 1. In addition, the spectrum contains the significantly broader peak at the wavelength $\lambda_{em}$, which has a width Bern and a height $I_{em}$.

To shift the white light point W into the ECE white light range, there is the approach in the related art of additionally doping the cerium-doped YAG phosphor using gadolinium atoms. These have the effect that the focal point of the color mixing travels to the right in the range B2, which corresponds to a tilt of the line L to the right. However, this results in an increased generation of heat in the phosphor, which is in turn accompanied by efficiency losses with respect to the luminous intensity. In addition, the increased generation of heat can result in the effect of so-called quenching, in the case of which an increase of the output of the laser diodes used for generating light from a specific laser output results in a reduction of the light output (so-called rollover).

Furthermore, there are approaches in the related art of mixing the cerium-doped phosphor with another phosphor, in particular with red phosphor, which is doped using europium, for example. A shift of the white light point into the ECE white light range can also be achieved using this mixture, but the above-mentioned quenching, which is generally reached upon the use of laser light sources, already occurs at relatively low temperatures with red phosphor. Therefore, stable color mixing can no longer be ensured in the case of longer operating time, since the red phosphor passes into quenching.

To bypass the above-described disadvantages, in the embodiment described here of the illumination apparatus according to the invention, two converting elements are used, which are spatially separated from one another and are thus thermally decoupled. This is apparent from the illustration of FIG. 3. The embodiment of a headlight shown therein comprises a laser light source 1 in a way known per se, which is only schematically shown and represents a white light source. The beam path of the light of the laser light source through the headlight is indicated by dashed arrows. The laser light source contains a laser diode 2, the blue light of which is oriented on a transmissive converting element 3. Using an optical unit (not shown), an essentially punctiform light spot made up of white light having high light density of $3\times10^8$ Cd/m$^2$ or more is generated on the converting element. In a way known per se, the converting element 3 is formed from cerium-doped YAG phosphor, so that the white light source has a spectrum which corresponds to the spectrum of FIG. 2 and lies at the edge of the ECE white light range.

Figure 3:
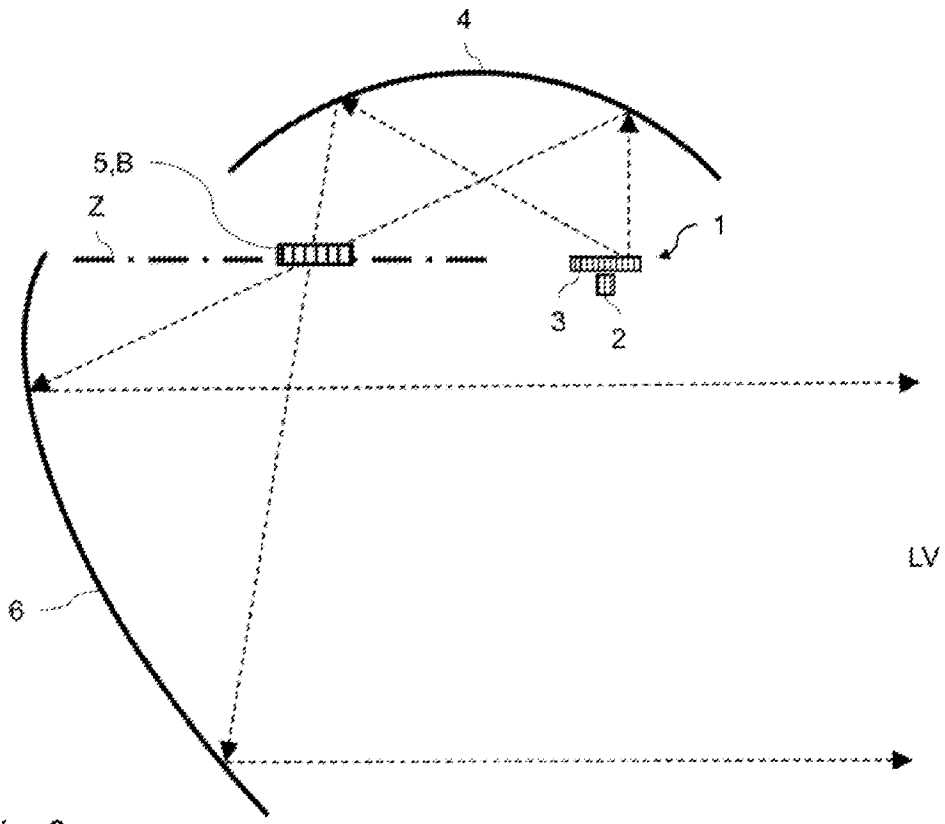
FIG. 3 shows a schematic illustration of an embodiment of an illumination apparatus according to the invention.

The white light source is optically imaged in the illumination apparatus of FIG. 3 by way of a first optical device in the form of a free-form reflector 4 in an intermediate image plane Z, i.e., a real image B of the light spot is generated in the intermediate image plane Z. A second transmissive converting element 5, which is formed from the red phosphor already mentioned above, is located at the location of this real image B. In contrast to the related art, the red phosphor 5 is now situated spatially separated from the phosphor 3 and is therefore thermally decoupled therefrom. This has the result that the heat which is induced by the wavelength conversion of the phosphor 3 no longer passes over to the phosphor 5. Accordingly, the heat development in the phosphor 5 is significantly reduced, whereby the above-described effect of quenching is avoided and a stable mixed color is obtained by the converting element 5.

The image B of the laser light source, the white light color mixture of which travels by way of the red phosphor 5 into the ECE white light range, is finally converted by a second optical device in the form of a secondary optical unit 6 into a light distribution LV on the road. The second optical device is again a free-form reflector, wherein the second optical device and similarly also the first optical device can also be designed differently and alternatively or additionally can comprise one or more lenses.

Figure 4:
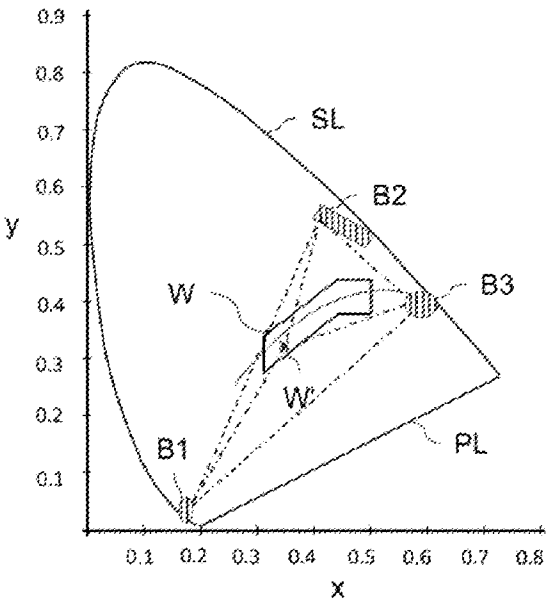
FIG. 4 shows the illustration of a color shift in the CIE chromaticity diagram which is achieved according to the embodiment of the illumination apparatus of FIG. 3.

FIG. 4 shows, on the basis of the CIE chromaticity diagram, the generation of white light as is effectuated by the headlight of FIG. 3. Similarly to the illustration of FIG. 1, the spectral color line SL and the purple line PL are again illustrated in the color space. In addition, the ECE white light range is shown as a polygon, wherein the reference signs W1 to W6 for the corner point of the polygon have been omitted for reasons of comprehensibility. A conversion of a part of the blue light into the red color range, which is identified by B3 in FIG. 4, is achieved by the red phosphor 5. This has the result that the original white light point W of the light of the white light source 1 travels from the edge of the ECE range into this range, so that the new white light color mixture is obtained at the white light point W'. The generation of the white light at the color coordinate W' is achieved without the above-described negative effects of quenching.

Figure 5:
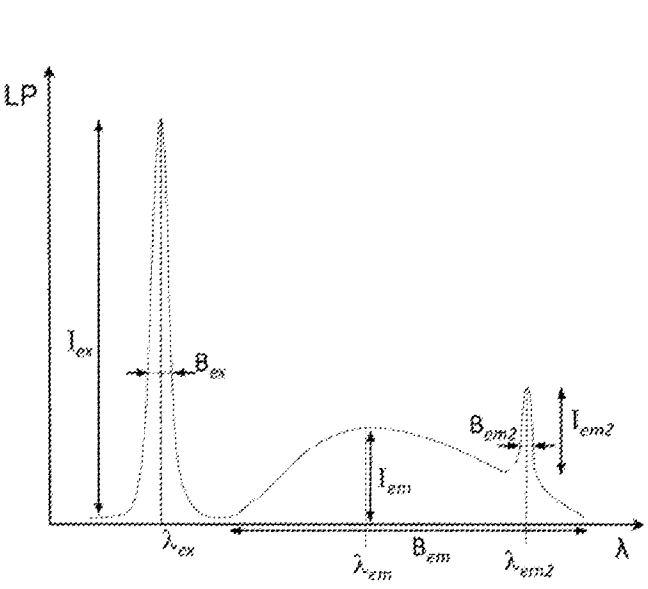
FIG. 5 shows the illustration of the spectrum at the white light point W' of FIG. 4, which is generated using the illumination apparatus of FIG. 3.

The spectrum of the light which is generated by the illumination apparatus of FIG. 3 at the white light point W' is shown in FIG. 5. Similarly to FIG. 2, the wavelength $\lambda$, is indicated along the abscissa and the light output LP is indicated along the ordinate. As can be seen, in addition to the peaks at the wavelengths $\lambda_{ex}$ and $\lambda_{em}$, the spectrum now contains a peak at the red wavelength $\lambda_{em2}$. This peak has a width of $B_{em2}$ and a height $I_{em2}$ and is effectuated by the conversion of light output in the blue wavelength range (peak at $\lambda_{ex}$) to the red wavelength range.

The embodiment of the invention described above has an array of advantages. In particular, a stable white light distribution at central points in the ECE white light range can be achieved using a motor vehicle illumination apparatus, whereby a preferred white light mixture is ensured for the light of headlights. The generation of heat is distributed by the thermal decoupling of two converting elements, whereby the negative effects of so-called quenching are avoided and a stable white light color is generated with high efficiency.

Although the invention was described above on the basis of generating white light, it can also be used similarly for generating other mixed colors. The thermal decoupling of two converting elements used for light conversion is essential to the invention. In addition, the invention can possibly also be used for two converting elements which consist of the same material, for example of the above-described cerium-doped YAG phosphor. In this case, at equal conversion rate, the two converting elements can be made thinner than in comparison to the use of a single converting element. This results in a reduced heat development in each converting element, which is in turn accompanied by a higher efficiency in the light generation and avoids the effect of quenching even at higher operating powers of the laser diodes.

LIST OF REFERENCE SIGNS x, y coordinates in the CIE chromaticity diagram
SL spectral color line
PL purple line
B1, B2, B3 ranges of mixed colors
W, W' white light points
L line
P double arrow
W1, W2, . . . , W6 corner points of the ECE white light range
LP light power
wavelength
Iex, Iem, Iem2 height of peaks
Bex, Bem, Bem2 width of peaks
λex, λem, λem2 wavelengths of peaks
1 light source
2 laser diode
3 first converting element
4 first optical device
5 second converting element
B real light of the light source
Z intermediate image plane
6 second optical device
LV light distribution

What is claimed is:

1. An illumination apparatus for a motor vehicle, the illumination apparatus comprising:

a light source for emitting light of a first mixed color, wherein the light source comprises a laser diode for generating monochromatic light and a first converting element for converting the monochromatic light into the light of the first mixed color;

a first optical device which images the light source as a real image in an intermediate image plane;

a second optical device which generates a predetermined light distribution from the real image in the intermediate image plane; and a second converting element at a location of the real image in the intermediate image plane wherein the second converting element is configured to convert the light of the first mixed color into light of a second mixed color.

2. The illumination apparatus according to claim 1, wherein the light source is an essentially punctiform light source.

3. The illumination apparatus according to claim 1, wherein the laser diode is configured to generate at least one of blue light, violet light, or UV light.

4. The illumination apparatus according to claim 1, wherein the first mixed color is a white light color.

5. The illumination apparatus according to claim 2, wherein the white light color is in the ECE white light range.

6. The illumination apparatus according to claim 1, wherein the second mixed color is a white light color.

7. The illumination apparatus according to claim 6, wherein the white light color is in the ECE white light range.

8. The illumination apparatus according to claim 1, wherein the second converting element is configured to shift the first mixed color toward the second mixed color into the ECE white light range.

9. The illumination apparatus according to claim 1, wherein the second converting element reduces light output in a blue spectral component of the first mixed color and increases light output in a red spectral component of the first mixed color.

10. The illumination apparatus according to claim 1, wherein at least one of the first converting element or the second converting element is formed from one of the following materials:

Ce:YAG phosphor, cerium-doped nitride phosphor, cerium-doped oxide-nitride phosphor, $CaAlSiN_3:Eu^{2+}$, $Sr_2Si_5N_8Eu^{2+}$, $M_2SiO_4:Eu^{2+}$ where $M=Ba^{2+}$, $Sr^{2+}$ or $Ca^{2+}$, $Sr_{1-x}AlSi_4N_7:Eu_x$ where x=0.03, $Li_3Ba_2La_3(MoO_4)_8$:(Eu3+,Tb3+), or $Y_2O_2S:EU^{3+}$.

11. The illumination apparatus according to claim 1, wherein the first converting element and the second converting element are formed from a same base material.

12. The illumination apparatus according to claim 1, wherein the first converting element and the second converting element are formed from different base materials.

13. The illumination apparatus according to claim 1, wherein at least one of the first converting element or the second converting element is remissive or transmissive.

14. The illumination apparatus according to claim 1, wherein at least one of the first optical device or the second optical device comprises at least one of one or more lenses or one or more reflectors.

15. The illumination apparatus according to claim 1, wherein the illumination apparatus is a headlight or a signal light.

16. A motor vehicle comprising an illumination apparatus according to claim 1.

* * * * *